US007021869B2

(12) United States Patent
Sanguinetti

(10) Patent No.: US 7,021,869 B2
(45) **Date of Patent: *Apr. 4, 2006**

(54) SEDIMENT CONTROL DEVICE AND SYSTEM

(76) Inventor: Peter S. Sanguinetti, 903 Lucas Rd., Lodi, CA (US) 95242

( * ) Notice: Subject to any disclaimer, the term of this patent is extended or adjusted under 35 U.S.C. 154(b) by 0 days.

This patent is subject to a terminal disclaimer.

(21) Appl. No.: 11/088,396

(22) Filed: Mar. 23, 2005

(65) Prior Publication Data

US 2005/0163568 A1 Jul. 28, 2005

Related U.S. Application Data

(63) Continuation of application No. 10/445,968, filed on May 23, 2003, now Pat. No. 6,905,289.

(51) Int. Cl.
*E02D 17/20* (2006.01)

(52) U.S. Cl. ..... 405/302.6; 405/21; 405/107; 405/115; 210/170; 210/747

(58) Field of Classification Search ..... 405/15, 405/16, 18, 32, 107, 114, 115, 302.6–7; 210/170, 210/747

See application file for complete search history.

(56) References Cited

U.S. PATENT DOCUMENTS

| | | | | |
|---|---|---|---|---|
| 4,362,433 | A | 12/1982 | Wagner et al. | |
| 5,389,166 | A | 2/1995 | White | |
| 5,632,888 | A | 5/1997 | Chinn et al. | |
| 6,056,438 | A | 5/2000 | Bradley | |
| 6,109,835 | A | 8/2000 | Grabhorn | |
| 6,296,420 | B1 * | 10/2001 | Garbiso | 405/111 |
| 6,368,017 | B1 * | 4/2002 | Black | 405/15 |
| 6,527,477 | B1 | 3/2003 | Allard | |
| 6,547,493 | B1 * | 4/2003 | Spangler et al. | 405/302.6 |
| 6,905,289 | B1 * | 6/2005 | Sanguinetti | 405/302.6 |
| 2003/0031511 | A1 | 2/2003 | Tyler | |

FOREIGN PATENT DOCUMENTS

| | | | |
|---|---|---|---|
| JP | 01021111 | * | 1/1989 |

* cited by examiner

*Primary Examiner*—Jong-Suk(James) Lee
(74) *Attorney, Agent, or Firm*—Stout, Uxa, Buyan & Mullins LLP; Frank J. Uxa; Linda A. Fox

(57) ABSTRACT

A Sediment control devices and systems generally includes a core made up of granular material encased within a puncture resistant fabric, a compressible layer enwrapping the core and a geotextile fabric outer casing. A plurality of such devices provide a system for controlling erosion and sedimentation.

16 Claims, 2 Drawing Sheets

FIG. 1
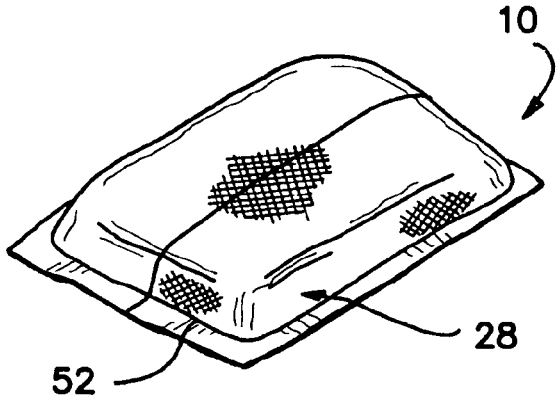
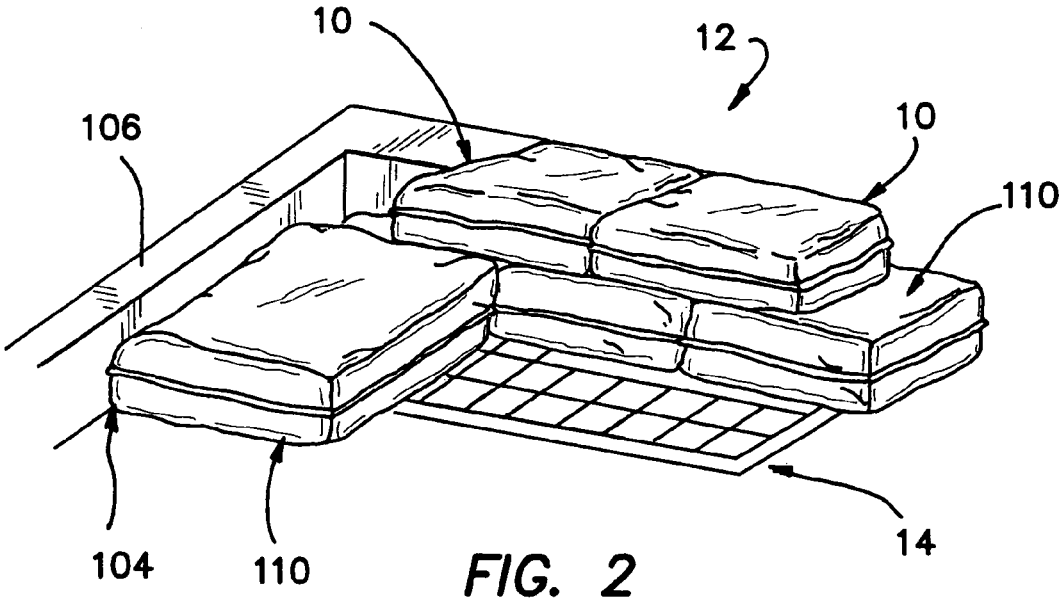
FIG. 2
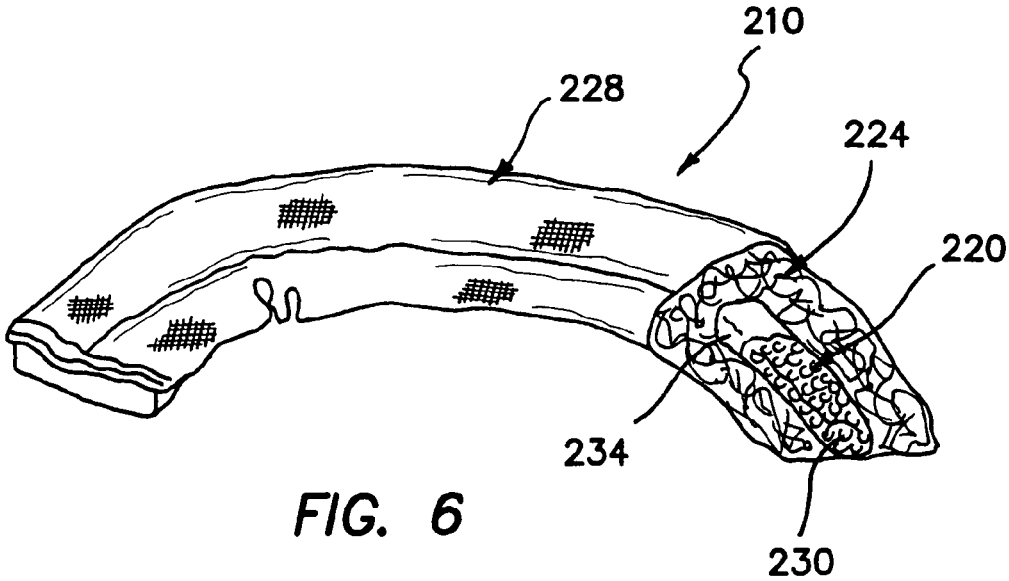
FIG. 6

SEDIMENT CONTROL DEVICE AND SYSTEM

This is a continuation of application Ser. No. 10/445,968, filed May 23, 2003, now U.S. Pat. No. 6,905,289, the entire disclosure of which is incorporated herein by this reference.

BACKGROUND OF THE INVENTION

The present invention generally relates to sediment control devices and systems useful for controlling soil erosion and sedimentation, for example resulting from construction activities.

Silt barriers, sandbags and concrete blocks are some of the many devices currently being used to control soil erosion and sedimentation resulting from industrial activities, such as construction projects and the like. Industrial activities such as highway and housing construction projects and the like, disturb and loosen soil, which is then vulnerable to being washed downstream during rains. The cumulative effect of these activities is a build-up of soil and other matter in waterways. This buildup of soil is generally known as sedimentation. Excessive sedimentation in waterways can destroy fish habitats, suffocate trees, clog streams, obstruct storm drains and culverts, pollute waterways, and cause other serious damage to the environment. Other detriments caused by excessive sedimentation include flooding, cost of repairing flood damage, expense of dredging estuaries and lakes, among others.

In addition to sediment loading, other pollutants are also generated from land disturbance associated with construction projects.

The Clean Water Act defines point source pollutants to include storm water discharge from such industrial activities as construction. As a result, an increased number of state environmental regulations have addressed the mitigation of construction site runoff and a variety of new erosion control methods have been proposed and implemented.

Construction activities related to building roads and highways, flood control projects, and land development for residential and commercial growth contribute sediments, organic matter, nutrients, metals, and other types of pollutants to water bodies. It is believed that sediment is the major pollutant associated with construction related activities, representing approximately 4–5% of the nation's sediment load to adjacent and downstream receiving waters.

Conventionally, sandbags have been used to supplemental other soil control measures, such as the installation of silt fencing, catch basins and the like. Conventional sandbags are inexpensive and convenient to install and are often placed adjacent disturbed areas to block sediment from entering drainage areas. Sandbags can also be used to divert flowing water to a stable drainage outlet. The most commonly used bags are untreated burlap sacks available at feed or hardware stores. Such bags are filled with sand to form a sandbag. Sandbag barriers are typically constructed on site by two people. A typical filled sandbag weighs around 30 to 40 pounds and can be dragged or carried by a single person.

Although they are convenient to install, the use of conventional sandbags in or around construction sites suffers significant drawbacks. For example, the bags regularly burst when run over by machinery or construction vehicles. For obvious reasons, broken sandbags will exacerbate sedimentation problems if not removed promptly. The useful life of a sandbag is estimated to be about 2 weeks on a typical construction site.

SUMMARY OF THE INVENTION

New sediment control devices and systems have been discovered. The present invention provides highly effective, durable and convenient devices and systems for sedimentation and erosion control. For example, the present devices can be used in place of conventional sandbags, without suffering the drawbacks associated therewith. The present devices and systems effectively control sedimentation resulting from soil erosion, for example as a result of construction site activities and the like.

The devices and systems of the invention are useful for controlling erosion and preventing sedimentation of waterways, for example by diverting flowing water, and/or blocking and removing sediment from a water flow, for example from an area under construction.

Advantageously, the present invention is useful in place of, or as an addition to, conventional sandbagging practices, but with substantially better results than sandbagging alone. For example, the present invention is useful for diverting rising floodwater away from homes or building structures, and preventing oversaturation of and erosion of hillside slopes. The present invention is suitable for meeting various erosion control requirements using practices which are substantially analogous to conventional techniques, for example, conventional sandbagging techniques and practices. Necessary or desirable adaptations of the devices and systems of the present invention for specific purposes will be readily appreciated by those of skill in the art.

Accordingly, devices and systems useful for controlling soil erosion and sedimentation are provided. In one broad aspect of the invention, the devices comprise composite bags generally including multiple layers of different materials enclosed within an outer covering. More particularly, the present devices preferably generally comprise a core, a compressible layer substantially surrounding the core, and an outer layer enclosing the compressible layer.

Preferably, the core comprises a relatively dense granular material. More preferably, the core comprises gravel filling. Even more preferably, the core comprises a filling of substantially non-angular gravel particles. For example, the gravel filling comprises smooth edged peat gravel. In one embodiment of the invention, the core comprises an inner bag, for example made of a geotextile material, or other suitable porous, high strength material, enclosing the granular material.

Preferably, the compressible layer substantially surrounds the core and comprises for example a fibrous layer made of natural or synthetic fibers. The compressible layer may comprise for example, wood fibers, for example, but not limited to aspen wood fibers. The compressible layer may comprise a fibrous blanket, for example a commercially available excelsior blanket, that is wrapped about the core.

The outer layer preferably comprises a nonwoven or woven geotextile material secured about and substantially enclosing the permeable material. For example, the outer layer preferably comprises a high strength, durable fabric, for example a woven fabric of monofilament of multifilament thread. The outer layer is sewn at edges thereof, forming a casing for the permeable layer. In one especially advantageous embodiment of the invention, the device includes a substantially squared portion on at least one end thereof in order to effectively seal the device against a structural surface, for example, a curb surface.

Advantageously, the device may be structured to filter and separate sediment contained in water that passes into and through the device. For example, the compressible layer may be a water permeable material that is effective in trapping coarse grained sediment that enters the device. The core is preferably structured to capture sediment, such as fine grained particles such as silt.

Preferably, none of the internal components of the present invention include sharp, jagged edges. The devices of the present invention are highly resistant to breakage, even when used in a high traffic area of a construction site. For example, the devices of the present invention, when used in place of conventional sandbags, have been found to have a longer useful life than conventional sandbags, for example, having a useful life of up to at least about 1 month up to about 6 months or more, whereas conventional sandbags typically have an expected useful life of only two weeks, when used in a similar setting or in an identical application.

In addition, the present devices are convenient to use. For example, the present devices are preferably sufficiently small in size and/or light in weight such as to enable lifting one of the devices by a single individual. The present devices are easily transportable, and can be used in any desired quantity and in various stacking configurations. For example, in a manner analogous to the use of conventional sandbags, depending on the application involved.

Any and all features described herein and combinations of such features are included within the scope of the present invention provided that the features of any such combination are not mutually inconsistent.

These and other features, aspects and advantages of the present invention will become apparent hereinafter, particularly when considered in conjunction with the following claims, detailed description and drawings in which like parts bear like reference numerals.

BRIEF DESCRIPTION OF THE DRAWINGS

FIG. 1 shows a perspective view of a sediment control device in accordance with the present invention.

FIG. 2 shows a perspective view of a system of the present invention for controlling sedimentation and erosion utilizing a plurality of devices similar to the device shown in FIG. 1.

FIG. 6 shows a perspective, partially cross-sectional view of another embodiment of the invention.

DETAILED DESCRIPTION OF THE INVENTION

Turning now to FIG. 1, a device for controlling sedimentation and erosion in accordance with the present invention is shown generally at 10.

A system 12 in accordance with the invention generally comprising a plurality of such devices 10 is shown in FIG. 2. Without intending to limit the scope of the present invention, the system 12 is shown being employed for diverting and filtering a water flow that is passing into a storm drain 14 located at a bottom of a slope adjacent a construction site.

Figure 3:
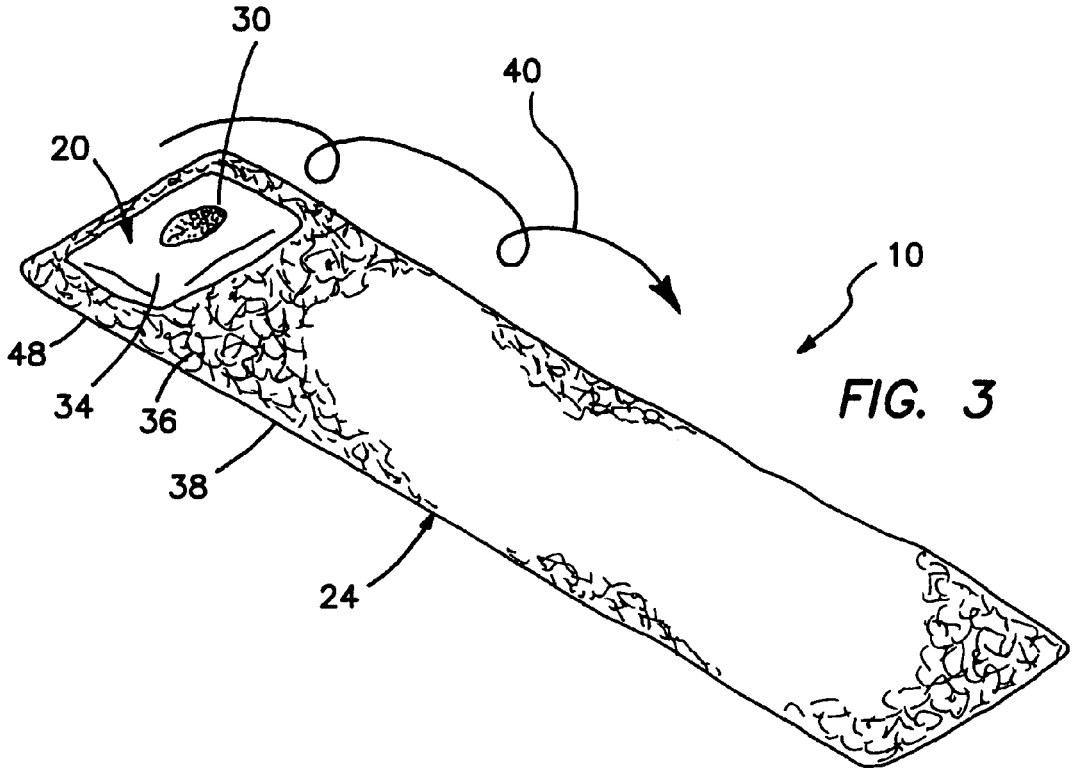
FIG. 3 shows a perspective view of the device shown in FIG. 1 during assembly thereof including a core and a compressible layer.
Figure 4:
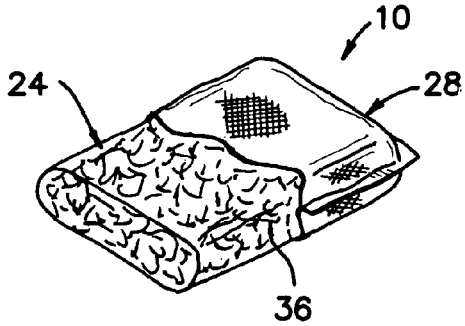
FIG. 4 shows a perspective view of the device shown in FIG. 1 having an outer layer partially removed in order to reveal the compressible layer encased therein.

Turning now to FIGS. 3 and 4, the device 10 generally comprises a core 20 (not visible in FIG. 4), a compressible layer 24 substantially surrounding the core 20, and an outer layer 28 (not shown in FIG. 3) enclosing the compressible layer 24.

Preferably, the core 20 comprises a granular material, such as an aggregate of sand, gravel, and/or crushed stone, for example, crushed granite and/or limestone.

More preferably, at least a major portion, that is, about 50% or higher, or substantially all of the granular material comprises granules 30 having substantially non-angular shapes, for example, substantially smooth or rounded shapes. In other words, at least a major portion of the granular material preferably mostly comprises granules 30 that have relatively low abrasion characteristics. For example, the granular material may comprise a natural rock-based polished gravel material, or a synthetic equivalent thereof. In one very useful embodiment, a major portion of or all of the granular material in the core 20 comprises peat gravel, for example but not limited to peat gravel having an average granule diameter of between about 0.2 inches and about 0.5 inches.

Preferably, the core 20 further comprises an inner enclosure 34 confining the granular material 30. The inner enclosure 34 may comprise a fabric material, for example a high strength, puncture resistant geotextile material. Preferably, the inner enclosure material is a high tensile strength and substantially puncture resistant, porous material. For example, the inner enclosure material may comprise a non-woven polypropylene geotextile having a high tensile strength, such as Mirafi® N-Series Non-Woven Geotextile. For example, the geotextile material is cut and stitched together to form a pocket enclosure which is filled with the granular material 30, and sewn shut.

The compressible layer 24 may comprise any suitable compressible material. In one very useful embodiment, the compressible layer 24 is effective to absorb, or lessen, a shock of impact on the device 10, for example when the device 10 is impacted by a vehicle, machinery, construction equipment and the like. For example, the device 10 is preferably structured such that the compressible layer 24 functions, at least in part, as a buffering element between the core 20 and the outer layer 28 such that upon the device 10, upon being overrun by construction vehicles and/or other heavy equipment, becomes compressed, causing air within the compressible layer 24 to be forced out through the outer layer 28. Upon the compressive load being removed from the device 10, the compressible layer 24 substantially recovers and substantially regains its original volume and shape in the uncompressed state. The device 10 thereby resists tearing, breakage, and/or otherwise being rendered ineffective for use, for example, even when the device 10 is subjected to relatively heavy usage.

In a preferred embodiment of the invention, the compressible layer 24 preferably comprises a fibrous material made of natural or synthetic non-woven fibers 36. The compressible layer may comprise for example, excelsior, straw, wood fibers, for example, but not limited, to aspen wood fibers. For example, a major portion of the fibers 36 making up the compressible layer 24 are curled wood fibers having a minimum length of at least about six inches allowing each of the fibers to interlock with one or more other of the fibers.

Preferably, as shown in FIG. 3, the compressible layer 24 comprises a fibrous blanket 38, for example but not limited to a rolled, stitched excelsior blanket. Preferably, the blanket 38 has a length sufficient to enable the blanket 38 to be wrapped about the core 30 at least once, and more preferably about two or more times. The compressible layer 24 may comprise, for example a continuous, fibrous blanket wrapped about the core (as shown diagrammatically by arrow 40 in FIG. 3).

An example of a blanket suitable for this aspect of the present invention is a Curlex® I Stitched erosion control blanket manufactured by the American Excelsior Company in Arlington, Tex.

Persons of ordinary skill in the art will appreciate that there are many suitable alternative materials that can be used for the compressible layer 24 within the scope of the present invention.

The outer layer 28 of the device 10 (not shown in FIG. 3) encases the compressible layer 24 and preferably comprises a porous material, preferably a water permeable material. The outer layer may comprise a natural material or a synthetic material.

In one particularly advantageous embodiment of the invention, the outer layer 28 comprises a geotextile material, preferably a puncture resistant, high tensile strength geotextile material. Geotextile materials are well known and are generally understood to include permeable fabrics manufactured for use in geotechnical engineering-applications. Geotextiles are generally made of synthetic materials, for example polypropylene, polyester, polyamide and/or polyethylene, that are formed into fabrics and are woven, non-woven, or combinations of woven and non-woven. As a specific example of the present invention, not intended to be limiting the scope of the present invention, the outer layer 28 comprises a Mirafi®-Series Non-Woven Polypropylene Geotextile material.

The inner enclosure 34 and the outer layer 28 may comprise substantially equivalent or the same materials.

Alternatively, the outer layer 28 may comprise sackcloth or a burlap material.

Construction of the present device 10 may be accomplished as follows. The core 20 is constructed by depositing a desired amount of granular material 30 into a casing that forms the inner enclosure. The opening of the inner enclosure is stitched closed in order to prevent the granular material from spilling therefrom. The core 20 is then placed on an end portion 48 of an unrolled excelsior blanket 38 as shown in FIG. 3. The core 20 and blanket 38 are then rolled, for example in direction shown by arrow 40, thereby causing the core 20 to be enwrapped by several layers of the compressible layer material. The core 20 and compressible layer 24 are then placed into an open end of a casing that forms the outer layer 28 and the open end of the outer layer is sewn shut, thereby forming device 10.

In another aspect of the present invention, a system 12 for controlling sedimentation and erosion is provided, for example as shown in FIG. 2. The system 12 comprises a plurality of the devices 10 as described in detail elsewhere herein. As shown, the devices 10 are designed to be placed side-by-side and/or layered on top of one another in any desired configuration, for example, adjacent a storm drain. Preferably, each individual device 10 is sized to be easily dragged and/or lifted by gone adult person.

Advantageously, the devices 10 of the present invention resist breaking, even when subjected to the harsh conditions associated with heavily used construction sites. Surprisingly, the present devices have been found to last up to about six months or more when used in conditions that would require sandbag replacement in only two weeks.

The present devices 10 and systems 12 function as effective filters of sediment contained in water that passes through the devices 10 or systems 12. Fine silt tends to become trapped within the core 20. Larger particulate matter tends to become trapped within the compressible layer 24.

Figure 5:
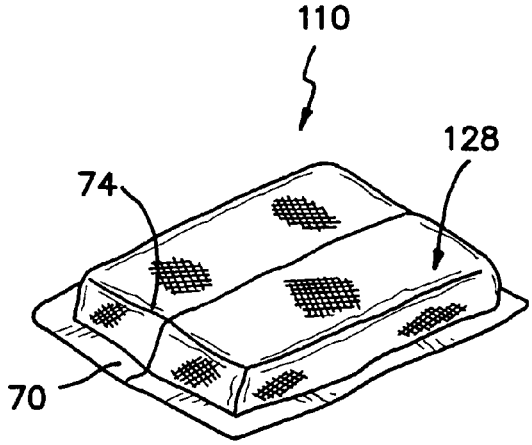
FIG. 5 shows a perspective view an embodiment of the invention having a squared edge feature.

Turning now to FIG. 5, another device for controlling sedimentation and erosion in accordance with the present invention is shown generally at 110. Except as expressly described herein, device 110 is similar to device 10. Features of device 110 which correspond to features of device 10 are designated by corresponding reference numerals increased by 100.

The most significant difference between device 10 and device 110 is that device 110 includes a substantially squared edge portion 70 that is structured to enhance the fit of the device 100 against a gutter or curb. Preferably, the squared edge portion 70 is provided along at least one of a length and a width of the device 110, and more preferably along at least a width of the device 110 as shown. This may be accomplished by providing, for example by sewing, at least one additional seam 74 into the outer layer 128 of the device 110 in order to form the substantially squared edge portion 70. Other embodiments of the invention may include substantially squared edge portions along more than one of the edges of the device 110, for example along each length and width of the device 110.

FIG. 6 shows yet another device 210 in accordance with the present invention. Except as expressly described herein, device 210 is similar to device 10 and device 110. Features of device 210 which correspond to features of device 10 and device 110 are designated by corresponding reference numerals increased by 200 and 100 respectively.

With reference to FIG. 6, the device 210 is sized and structured to be placed generally around a perimeter, for example a substantially entirely full or complete perimeter of a storm drain (not shown), for example in a curved fashion. Thus, it can be appreciated that device 210 may be made available in a plurality of sizes in order to accommodate various sizes of storm drains or other applications to which the device 210 may be suitable.

Like devices 10 and 110, device 210 is preferably a multilayered structure comprising a core 220 having a granular material 230 enclosed within an inner enclosure 234, a compressible layer 224, and an outer layer 228. As shown, device 210 is elongated and somewhat cylindrical in form and is structured to be sufficiently flexible in order to allow placement of the device 210 in the form of a desired configuration. For example, the flexibility of device 210 is preferably sufficient to allow placement of the device 210 in at least one of a C-shaped configuration (shown), a substantially straight, linear configuration, a circular configuration, a hook shaped configuration and the like configurations. Advantageously, the device 210 has a structure, for example a sufficient weight or mass, to prevent the device 210 from rolling or otherwise becoming inadvertently displaced, for example by water flow or construction site vehicle traffic.

When used in place of conventional sandbagging, the present devices 10, 110, 210 have been found to be superior in filtering particulate material from a flow. The devices 10, 110, and 210 and systems 12 are useful as sediment traps, for example, by catching coarse particles being transported by small concentrated flows, for example in gutters and adjacent curbs. As shown in FIG. 2, a plurality of devices 10 and/or 110 may be placed against a curb 106 such that devices 10 and/or 110 are positioned to provide at least a partial seal or obstruction against an unfiltered flow into the drain inlet 14. One or more of elongated devices 210 may be utilized in a similar manner by simply configuring the shape of the device 210 to at least partially, or substantially entirely, block a flow from entering a drain or other area in which filtering of a flow is desirable or necessary.

The devices 10, 110 and 210 and systems 12 can also be used as small check dams, for example to reduce water velocity in a channel, thereby allowing some sediment particles to settle out of the flow. The devices 10, 110 and 210 and systems 12 also effectively function to control erosion below a slope and can be employed to divert flowing water away from an unstable area to a more favorable drainage area. In large measure, the devices 10, 110 and 210 and systems 12 can be effectively used in many, or all, of the applications in which sandbags can be employed. These are a only a few of the possible applications for the present devices 10, 110, and 210 and systems 12, and it will be appreciated by those of ordinary skill in the art that there are many other useful applications therefore.

While this invention has been described with respect to various specific examples and embodiments, it is to be understood that the invention is not limited thereto and that it can be variously practiced within the scope of the following claims.

What is claimed is:

1. A sediment control device comprising:

a composite bag useful in at least one of filtering a flow of water and diverting a flow of water, the composite bag comprising a core;

a non-woven compressible layer substantially surrounding the core, the core having a higher weight per unit volume than the compressible layer; and an outer enclosure substantially entirely surrounding both the compressible layer and the core.

2. The device of claim 1 wherein the outer enclosure is substantially entirely closed about the compressible layer and the core.

3. The device of claim 1 wherein the core is substantially non-compressible.

4. The device of claim 1 wherein the core comprises a granular material.

5. The device of claim 4 wherein a major portion of the granular material comprises peat gravel.

6. The device of claim 1 wherein the core comprises a substantially non-compressible granular material and an inner enclosure confining the granular material.

7. The device of claim 6 wherein the inner enclosure comprises a porous material.

8. The device of claim 1 wherein the compressible layer comprises a fiber material.

9. The device of claim 1 wherein the compressible layer comprises excelsior.

10. The device of claim 1 wherein the compressible layer comprises a fibrous blanket.

11. The device of claim 1 having an elongated, multilayered structure.

12. A sediment control device comprising:

a composite bag useful in at least one of filtering a flow of water and diverting a flow of water, the composite bag comprising a substantially non-compressible core, a non-woven compressible layer comprising a fibrous material selected from excelsior, natural straw, synthetic fibers, and combinations thereof, the compressible layer substantially surrounding the core, and an outer enclosure substantially entirely surrounding both the compressible layer and the core.

13. The device of claim 12 wherein the core comprises a granular material.

14. The device of claim 13 wherein a major portion of the granular material comprises peat gravel.

15. The device of claim 12 wherein the core comprises a granular material, and the composite bag further comprises an inner enclosure confining the granular material.

16. The device of claim 12 wherein the outer enclosure is substantially entirely closed about the compressible layer and the core.

* * * * *